US005906060A

United States Patent [19]

Tonry

[11] Patent Number: 5,906,060

[45] Date of Patent: May 25, 1999

[54] MANUALLY PUSHED SNOW SHOVEL

[76] Inventor: Robert Tonry, 15 Jay Rd., Scituate, Mass. 02066

[21] Appl. No.: 08/926,783

[22] Filed: Sep. 10, 1997

[51] Int. Cl.[6] ..... E01H 5/02

[52] U.S. Cl. ..... 37/270; 37/285; 294/54.5; 294/59

[58] Field of Search ..... 294/49, 54.5, 55.5, 294/56, 59; 37/241, 265, 266, 270, 271–273, 276–278, 282, 285; 254/131.5

[56] References Cited

U.S. PATENT DOCUMENTS

| | | | |
|---|---|---|---|
| 787,921 | 4/1905 | Hooper | 294/54.5 X |
| 845,549 | 2/1907 | Henry | 37/244 X |
| 938,283 | 7/1909 | Schultze . | |
| 1,206,235 | 11/1916 | Luther . | |
| 1,232,361 | 7/1917 | Mills . | |
| 1,779,090 | 10/1930 | Fick | 37/271 X |
| 2,460,560 | 2/1949 | Williams . | |
| 2,484,409 | 10/1949 | Jameson . | |
| 2,598,952 | 6/1952 | Weingart . | |
| 2,605,561 | 8/1952 | Maynard et al. . | |
| 2,772,490 | 12/1956 | Hnastchenko . | |
| 2,846,785 | 8/1958 | Underwood . | |
| 2,852,872 | 9/1958 | Benz . | |
| 2,884,720 | 5/1959 | Meyer et al. . | |
| 2,895,237 | 7/1959 | Abrahams | 37/278 X |
| 2,933,836 | 4/1960 | McKinley | 294/54.5 X |
| 3,218,738 | 11/1965 | Bowerman | 294/54.5 X |
| 3,391,478 | 7/1968 | Astill . | |
| 3,656,557 | 4/1972 | Eskelson et al. . | |
| 4,547,011 | 10/1985 | Stewart | 294/54.5 |
| 4,865,373 | 9/1989 | Hudson . | |
| 5,271,169 | 12/1993 | Konsztowicz . | |

FOREIGN PATENT DOCUMENTS

| | | | |
|---|---|---|---|
| 687138 | 5/1964 | Canada . | |
| 892438 | 2/1972 | Canada . | |
| 3500249 | 7/1986 | Germany | 294/54.5 |

*Primary Examiner*—Johnny D. Cherry
*Attorney, Agent, or Firm*—Jeffrey P. Calfa

[57] ABSTRACT

An improved manually pushed snow shovel in which the user's natural pushing force acts to alleviate stalling friction. A version of a manually pushed snow shovel having features of this invention comprises a blade with a leading edge, a handle attached to the blade, and at least one, although two are preferred, ski runner(s) attached to the blade. The ski runner(s) are attached such that when in the shovel is in use, the leading edge of the blade is at or behind the portion of bottoms of the ski runner(s) normally in contact with the ground. This ensures that the shovel pivot point or point of downward vertical force from the snow load is forward of the leading edge relative to forward movement of the shovel. As such, the user's natural forward pushing on the handle and hence indirectly to the blade results in the leading edge moving upwards away from the ground upon encountering increased friction due to heavy snow or rough ground surfaces.

4 Claims, 3 Drawing Sheets

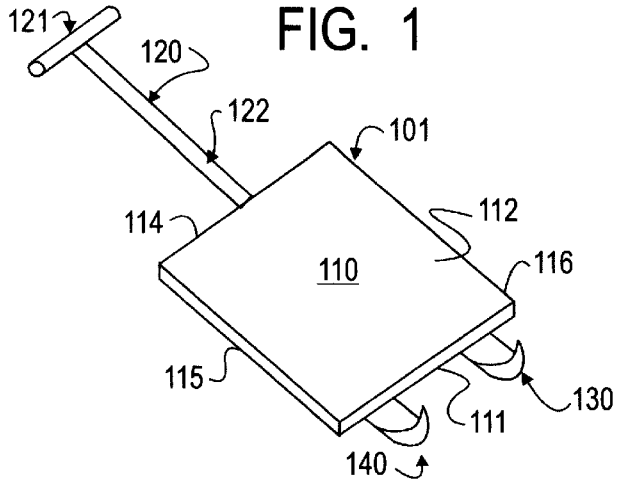
FIG. 1
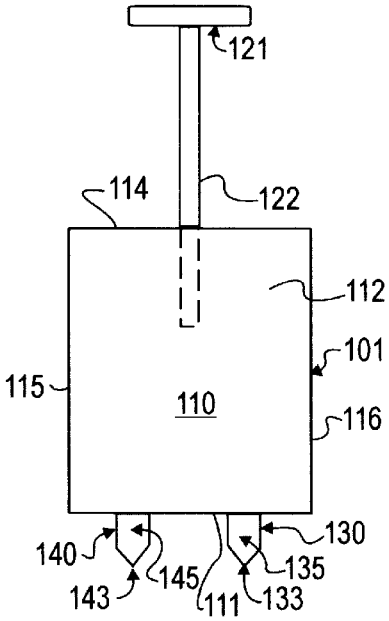
FIG. 2
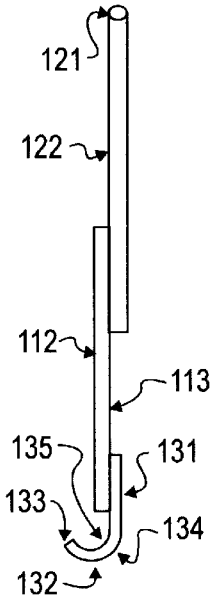
FIG. 3
FIG. 3B
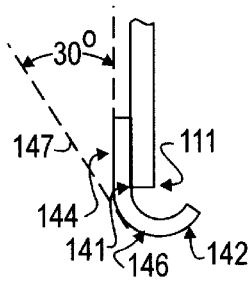
FIG. 3A
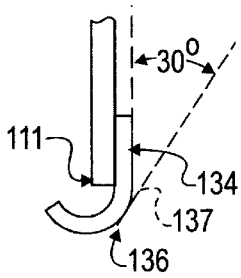
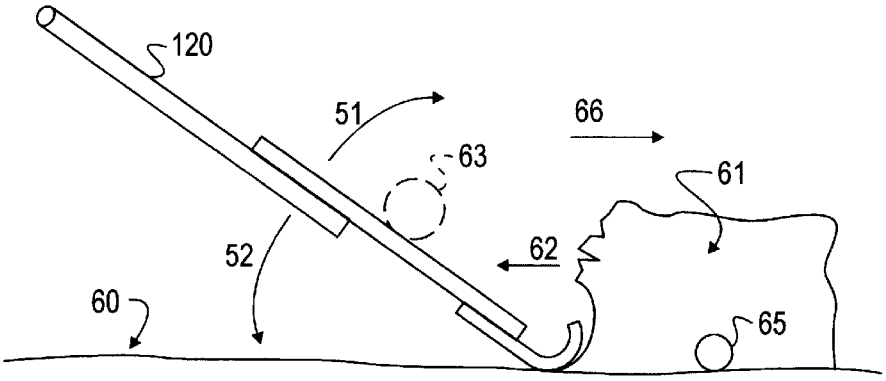
FIG. 4

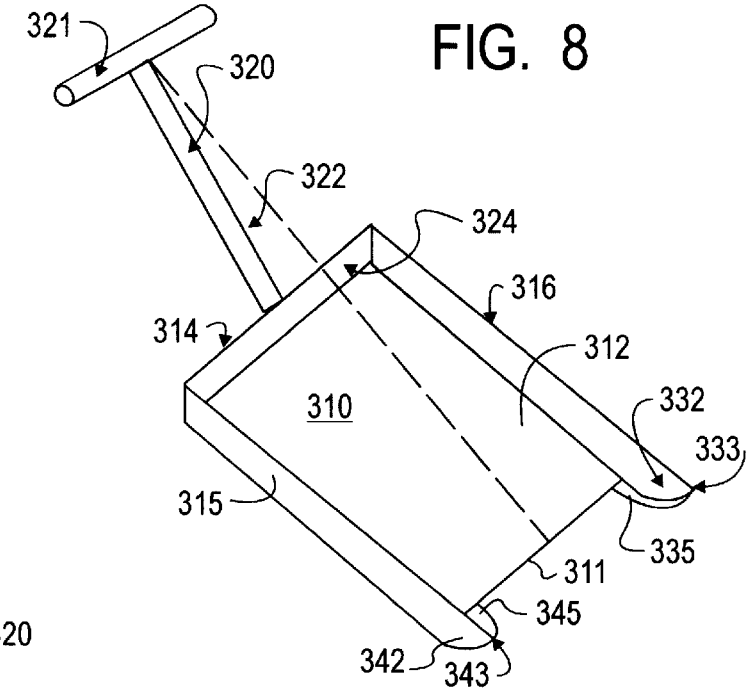
FIG. 8
FIG. 9
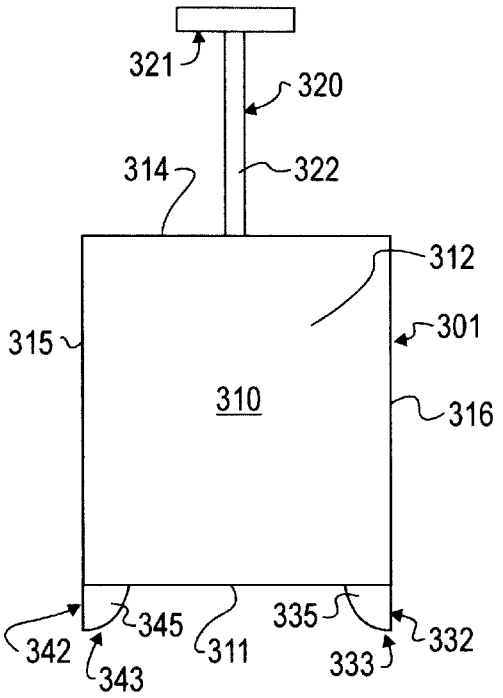
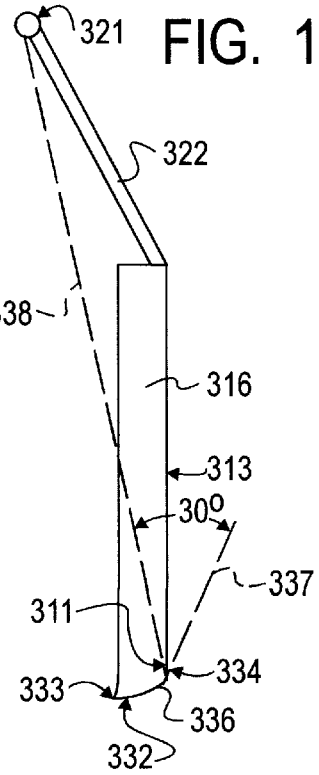
FIG. 10
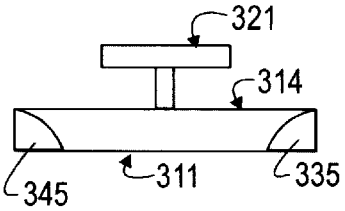
FIG. 11

MANUALLY PUSHED SNOW SHOVEL

BACKGROUND

This invention relates to snow shovels, and more particularly to manually pushed snow shovels. Traditional snow shoveling involves lifting and throwing snow which is hard work and potentially injurious to the user's back. To reduce the work and use of the back, shovels have been developed which allow the user to physically push the snow aside rather than having to lift it. Snow is moved off of horizontal ground surfaces by sliding the push blade across the ground surface, collecting the snow on the blade and then moving the snow to a desired location and tilting or lifting the blade to remove the snow from the blade. Existing manual push shovels are not entirely adequate for the job, however, since movement through the snow can stall before an entire pass is achieved. Snow shovel stall is a consequence of the snow load compressing ahead of the blade and friction of the blade with the ground which increases in accord with the snow load increase and ground irregularity. Once stall has occurred, snow is lifted and thrown or more time is expended to slide it away on the shovel.

Certain designs in the prior art are designed to allow the user to scrape the ground in order to assure a good snow removal job. These prior art shovels have a wheel or a skid system located under the blade and behind its leading edge. Some examples of such wheel supported shovel blades are found in U.S. Pat. Nos. 1,206,235: 1,232,361; 2,460,560; 2,598,952, 2,772,490; 2,846,785; and 2,852,872. Some skid supported shovel blades are found in U.S. Pat. Nos. 2,484, 409 and 5,271,169 and Canadian Patent Numbers 687,138 and 892,438.

Support behind the blade leading edge provides a fulcrum point on which the shovel user pivots the blade edge downward by the horizontally forward and the resultant upward pushing force on the handle which is the natural direction in the course of moving snow. The resultant upward motion of the handle from the pushing of the shovel horizontally forward is the result of the forward pivoting of the handle due to a friction increase against the blade. A shovel user of the prior art will have to expend energy away from the task of moving snow by fighting the shovel handle tendency to pivot forward and upward by exerting a downward counter pivoting force on the shovel handle. The prior art with the blade support behind the leading edge has this problem with blade friction with the ground and catching on irregularities in the snow.

The location of blade support behind the leading edge was apparently the logical place to carry the snow load and does somewhat reduce blade friction with the ground. However, the downward pivoting of the blade as a result of the natural forward and upward pushing force on the shovel handle results in a friction increase at the blade leading edge as the pushing on the handle is increased to overcome an increasing snow load. The increasing friction and any ground irregularities contribute to the stalling of blade forward motion. The user's natural forward and upward pushing force intensifies the stall. A downward push on the handle is required to lift the blade up and free it so the snow load can be dumped or slid out of the snow removal path.

Other shovel blades shown in U.S. Pat. Nos. 4,865,373 and 928,283 have wheels or revolving bodies in front of the blade leading edge. These relatively small wheels or bodies hold the blade leading edge close to the ground. The problem with this scheme is that during snow shoveling, the small wheels tend to get stuck in slush and surface irregularities found in gravel driveways, grass turf, brick walkways, and frozen ruts.

While small wheels can get stuck, larger wheels positioned forward of the blade may not. However, larger wheels and their mounting assembly required to hold the blade close to the ground tend to be expensive. Larger wheels resist forward motion when they freeze or rust, and by their higher profile or greater surface area against the snow.

According to this reasoning the shovel of U.S. Pat. No. 4,865,373 provides a second set of larger wheels behind and under the blade where they are less subject to breakage or failure by freezing or rusting. This also increases the blade longitudinal support and fixes the blade angle and height over and out of ground and reduces the weight shift forward to the small front wheels. So fixed and designed, the blade can build a snow load ahead of it which contributes to stalling by friction buildup or catching of the wheels.

Similar to other shovels with runners or wheels behind the blade leading edge, the specified way to relieve this friction on the U.S. Pat. No. 4,865,373 shovel is to unload the blade by moving the blade handle downward to raise the blade leading edge away from the ground. This downward movement of the shovel handle while maintaining forward shovel movement is difficult and results in snow being left behind. As stated earlier, the user natural force on the shovel handle is horizontally forward and upward and this natural force tends to intensify stalling in heavy snow.

Skids shaped with a curvature like skis or runners are found in a variety of devices more complex and elaborately constructed than a simple manual push shovel. The snow blower of U.S. Pat. No. 2,605,561 shows runners to guide a shallow angled blade over the ground. As in the prior art push snow shovels, most of the weight is balanced over the rear wheels located slightly behind the center of gravity. This precludes a forward pivot of the blade. Instead, the blade is freed traditionally by a downward handle motion that raises the blade upward while pivoting on the rear wheels.

Some automobile or truck pushed snow removal devices have had runners which carried the weight of their shovel blades directly under the blade leading edges. However, these vehicle pushed snow removal devices have fixed blade angles and fixed blade heights. The runners were actually displaced from and indirectly attached to the blades. The displaced runners of the vehicle pushed snow shovels were designed to have the flat portions of the runners maintain contact with the horizontal ground surface to be plowed. There is no pivoting on the feet or runners upon which the weight of the blades are held since the rear of the blades are affixed at a set height to a vehicle. This prohibited any rotation or pivoting of the blades on these devices. Comparison with manually pushed snow shovels is limited as a result. Some examples of vehicle pushed snow removal devices which carry the weight of the blade directly below to behind the leading edge of the blades on the flat portions of the runners are U.S. Pat. Nos. 2,884,720 and 3,391,478.

Push snow shovels of the prior art utilize skids or wheels under the blade and behind the blade leading edge. These skids or wheels support the snow load. These designs provide some improvement in the physical work required, however blade edge friction with the ground is still a problem especially over rough surfaces. The user natural forward force on the handle that causes the shovel to move forward also causes the blade edge to scrape the ground with increasing friction as the snow load builds. Eventually a stall occurs by this friction or when the blade edge or small wheels catch on a rough surface or thick wet snow.

For the foregoing reasons, there is a need for a manually pushed snow shovel with which the user's natural forward and upward pushing force on the shovel handle alleviates rather than intensifies stalling friction with the ground.

SUMMARY

The present invention is directed to a device that satisfies this need for a manually pushed snow shovel with which the user's natural forward and upward pushing force on the shovel handle alleviates rather than intensifies stalling friction with the ground. A version of a manually pushed snow shovel having the features of the present invention comprises a blade and a handle, the handle being attached to the blade. Viewed from the top, the blade can be triangular or rectangular shaped. The blade has a front face, a rear face, and there are three sides for the triangularly shaped blade and four sides for the rectangular shaped blade. Although relatively flat, there are obvious and well known blade designs available wherein: the blade may be somewhat curved or contain ridges within its surface. The blade is designed to accumulate or push snow. In both the triangular shaped or rectangular shaped blade shovels, one of the blade sides is designated the leading edge. The leading edge is the blade side opposite where the handle is attached to the blade and which first encounters snow as the shovel user pushes the device along the ground in the forward direction.

The blade has at least one ski runner attached to the blade and extending out and forward from the leading edge. The ski runner inclines upwards to provide an area for rotation on the ground surface to be shoveled. The ski runner may be either fixed pivotably or not pivotably to the blade. The ski runner may resemble the front portion of a conventional downhill ski in that the ski runner is a relatively flat piece with a narrow flat face which gently curves concave upwards to the end. The end may be tapered to form a point.

In the preferred embodiment, there are two ski runners attached to the blade and these ski runners are attached to the rear face of the blade. Additional ski runners may be used to enhance stability. Viewed from the top, the ski runner(s) extend perpendicularly from the leading edge and are thereby aligned with the track of forward shovel motion when the shovel is in use. Each ski runner has a flat portion that transitions into a gently curved or upwards inclining portion leading to a narrowed tip. The gently curved portions of the ski runners are positioned concave up relative to the front face of the blade and away from the ground surface when the shovel is in use. The bottom's gently curved portion of the ski runners are the only part of the shovel always in contact with the ground when the user is pushing snow. Viewed from the side, the leading edge is at or behind (relative to what would be shovel user forward motion) the point on the bottom of the ski runner(s) from which an imaginary tangent line drawn forms approximately a 30 degree angle with the sides of the blade where the blade is flat. Where the blade is curved or the handle is not parallel to the blade, the leading edge, when viewed from the side, is at or behind the point on the bottom of the ski runner(s) from which an imaginary tangent line drawn forms approximately a 30 degree angle with a line between the handle where gripped and the leading edge.

There are certain key elements to the shovel construction. The runner is at least an upward incline from the ground forward of the blade relative to forward motion. This incline is preferred to be a gentle curvature like the forward end of a snow ski. A runner with a gentle curvature is preferred since it is less likely to stall on rough ground surfaces or fall in nooks and crannies. Moreover, the runner quite suitably and economically achieves the radius of curvature of a much larger and more expensive wheel and its mounting apparatus that is rendered impractical.

Typically the curved runner portion or a flat portion adjoining it supports most of the shovel and snow load weight forward of the blade. A pivot point for the blade is provided adjacent to the runner and forward of the blade while the shovel is in an operating position. A substantially fixed blade and runner relative motion places the pivot points along the bottom of the runner and on the forward runner curvature during pivoting. A pivotable interconnection between the ski runner and blade will allow relative movement between the two components and such connection will be the pivot point of the shovel. When this relative movement is allowed, the pivot point can be at a pivotable interconnection of the runner and blade. So located, the pivot point(s) adjacent to the runner portion normally in contact with the ground holds most of the shovel weight forward of the blade leading edge.

A typical operating position of the shovel with the ground as viewed from the side, is approximately 30 degrees. This angle is described as approximately thirty degrees because it is expected that the angle will be actually be between twenty and forty five degrees depending on the comfort level of the user during forward motion and pivoting of the shovel. Where the blade is a modified bucket shape concave up in which the sides do not reflect the line of force of the user applied to the blade, the angle is measured between a line from the handle where gripped to the blade leading edge and the ground. The blade can be pivotably attached to the runner or they can be fixed together so that there is no substantial relative movement.

The attachment of the ski runners to the blade can be non-permanent by means of screws or other means. This will allow for blade height over ground adjustments.

The bottoms of the ski runners may be coated with a non-stick surface such as paraffin or the entire runner can be made out of a non-stick substance such as a plastic. The ski runners may be made integral to the blade where the blade and ski runners are made of the same material as in the example of the use of a plastic or aluminum alloy. Many plastics and fiber reinforced plastics can be molded to form this shovel shape, however, slippery and strong thermoplastics like nylon and high density polyethylene are preferred. The leading edge may be protected by a metal overlay coating where the blade is made of plastic or soft metal like aluminum.

The relative location of the leading edge to the ski runner point of contact with the ground ensures that the shovel pivot point is forward of the leading edge relative to forward shovel pushing motion by the user. As such, the user's natural forward and upward pushing force on the handle and hence the blade causes the leading edge to move away from the ground upon encountering increased friction with the ground. The shift of the pivot point to forward of the leading edge is opposite the prior art of manual shovels and results in a non-obvious desirable result. The user's natural forward and upward pushing force on the handle acts to alleviate rather than intensify stalling friction with the ground as the natural force causes the leading edge to rise upon a friction increase. The horizontal counter force vector lessens as the handle is raised. The initial angle with the ground can be an approximately thirty degrees because it is not absolutely critical that the pivot point be forward of the leading edge when the shovel blade is at thirty degrees with the ground and the user applies the natural forward and upward pushing force upon a friction increase. What is critical is that the user may need only pivot the handle forward and hence the blade only a relatively small amount to have the leading edge behind the pivot point and hence lift away from the ground surface upon the friction increase.

Handle motion upwards may be reduced or eliminated by pivotably connecting the handle to the blade with a spring loaded releasing device or other similar means which would release the blade to rotation of tilt upon encountering excessive forward force on the handle. This spring loaded device option would contain mechanical stops which would control the range of the handle to shovel blade pivoting. The spring loaded releasing device would re-engage when the force diminished due to the shovel passing over the obstruction or unloading of the snow from the shovel.

The shovel with the triangular shaped blade may be further enhanced by the addition of a snow director. The snow director is essentially a straight flat elongated piece rotatably attached to the top and center line of the front face of the triangular blade and suitably angled there from such as approximately perpendicular to the blade face. The snow director may be pivoted to either side of the blade with mechanical stops built into the front face of the blade to maintain the snow director on one side or the other. The snow director will act to force snow off of the opposite side of the front face of the blade from which the snow director is positioned. The snow director accomplishes this purpose by inhibiting snow from falling off of the side of the front face on which the snow director is positioned. The fact that the blade is triangular shaped facilitates the snow falling off the opposite side of the blade while reducing sideways force tending to push the shovel off its track. The consequence of this feature is increased work efficiency by less work stoppage since by shoveling a driveway lengthwise fewer passes are required.

Another variation of the shovel with the triangular shaped blade would have the blade comprised of an additional triangular shaped extension on the blade on the side opposite the leading edge. The second triangular face would give the blade an hour glass type shape when viewed from the top. The original triangular face would still serve for snow collection. The snow director would be rotatably joined near the junction of the original triangular face and the additional upper triangular surface. A portion of the snow director would extend up to the additional upper triangular surface, allowing the user to manually swivel the snow director to wipe snow from the front face of the blade during use. This design is readily molded of plastic by thermoforming with vacuum, compression, molding FRP, or by any other suitable process of manufacture.

It is also envisioned that the snow director could be automatically moved by a motor means to provide a wiper like motion back and forth across the front face of the snow shovel. The wiper like motion would clear the front face of accumulating snow. Alternatively, a blower can be mounted on the face of the blade to blow the snow to either side of the blade and off to the side.

Another version of a manually pushed snow shovel having features of the present invention is a scoop shovel comprised of a relatively flat rectangular blade with raised sides for collecting snow, two ski runners, and a handle; the ski runners being integral to the raised sides. The blade has a leading edge and a rear edge on the opposite side of the leading edge. When viewed from the side, the raised side has four edges; the forward most edge curving concave upwards away from the leading edge to overhang over the leading edge to form a tip. These combination edge runners may have variable width on the portions in contact with the ground; they may be as wide as conventional downhill skis or as narrow as ice skates. Once again, an important element of construction of this version is that the leading edge is at or behind the portion of the combination edge runners normally in contact with the ground during use of the shovel.

The first prototype of this shovel was made using two conventional downhill skis and a piece of plywood for the blade. The skis were concave up relative to the front face of the blade and also to the ground when in use. The long flat portion of the skis runner extended out from the rear edge of the blade, while the gently curved portions extend out and forward from the leading edge. Once again an important element of construction of this version is that the leading edge was at or behind a portion of the skis normally in contact with the ground. Two cross pieces were attached between the long flat portions of the skis to provide stability and additional user gripping locations.

The first object of the invention is for the user's natural forward and upward pushing force on the shovel handle to alleviate rather than intensify shovel stalling friction with the ground. The shift of the shovel pivot point to forward of the leading edge satisfies this objective. The horizontal force vector pushing the blade forward increases as the handle is lowered.

The second object of the invention is to allow a complete range of blade to snow covered surface angles while not inducing stall during shovel movement in heavy wet snow. The bottom portions of the runners of the shovel are the only parts of the shovel always in touch with the horizontal surface. As such the curved portions of the runners are typically the point of downward vertical force during shovel use and are the pivot points as the handle is moved either upwards and forward or downwards. Since pivot points of the shovel are forward of the blade leading edge, the blade to horizontal surface can be varied over the complete range from completely parallel to the horizontal ground surface or zero degrees for moving a snow load away to ninety degrees or beyond for off loading snow and compacting it into a snow bank. This complete range of shovel angles can be obtained while maintaining the blade leading edge engaged into the snow for useful work. Forward shovel motion can be maintained over a broader range of shovel angles for manipulating snow. The non-obvious location of a shovel pivot point forward of the leading edge and the use of the curved portions of ski runner(s) or the like as the pivot points on this shovel allow the complete range of shovel angles while the shovel is engaged in snow on the ground surface and moving in the forward direction. These capabilities are non-trivial and most valuable for the shovel user. Previous push snow shovels were sometimes at the mercy of the horizontal surface below the snow. Surface irregularities such as chunks of ice or rock often caused the previous shovels to stall upon impact with the blade leading edges. The ability of a user of this invention to vary the shovel angle allows the user to either reduce the angle and blade height to remove the irregularity with an increased horizontal force vector on the blade or increase the angle and blade height as necessary to ride over the irregularity as would be needed for frozen ridges of snow left from previous storms.

The ability of this invention to pivot the blade allows the user to vary the height of the blade from the horizontal snow covered surface. As the handle means is rotated downward about the pivot point, the blade is pivoted or tilted backwards and the height of the blade is reduced. Conversely rotating the handle means upwards about the pivot point increases the height of the blade over ground. The ability to vary blade height also assists in allowing the user of this invention to push the shovel over or through surface irregularities. The blade height is lowered to clean snow close to the ground or to capture or break up some relatively loose irregularities and the blade height is raised to circumvent or push over excessive friction elements like fixed surface irregularities. Lowering the handle lowers the blade closer to the ground where it can clean better at the cost of increased efficiency. Ideally, the lower handle position provides an increased horizontal component to help drive the blade through ground friction and irregularities. It should be noted that blade height and angle re-positioning is typically accomplished while still maintaining some leading edge engagement with the snow on the ground surface and with little or no interruption in the work efficiency.

The present invention has price economy over prior art while providing unique characteristics not previously possible. The invention is simple in that it can be made cheaply with very few parts. The blade and runners can be manufactured as a single molded piece or separately. The handle can be as simple as a wooden broom handle so long as it is firmly attached to the blade. The shift of the pivot point to forward of the blade leading edge through the use of and positioning of ski runners or the like which clear themselves and the blade of obstruction friction by blade height change without disturbing the work efficiency is a special non-obvious characteristic of this invention.

These together with other objects of the invention, along with various features of novelty which characterize the invention are pointed out with particularity in the claims annexed hereto and forming a part of this disclosure. For a better understanding of the invention, its operating advantages and the specific objects attained by its uses, reference should be had to the accompanying drawings and descriptive matter in which there are illustrated three alternative versions of the invention.

BRIEF DESCRIPTION OF THE DRAWINGS

FIG. 1 is a perspective view of a shovel embodying features of the preferred embodiment of the present invention for an improved manually pushed snow shovel.

FIG. 2 is a top view of the shovel of FIG. 1.

FIG. 3 is a left side view of the shovel of FIG. 1.

FIG. 3A is a blown up left side view of a portion of FIG. 3.

FIG. 3B is a blown up right side view of FIG. 1 showing the right side equivalent features of FIG. 3A.

FIG. 4 is a right side view of the shovel of FIG. 1 shown relative to a horizontal ground surface to demonstrate its use.

FIG. 8 is a perspective view of a shovel having sides integral to its ski runners embodying features of the present invention for an improved manually pushed snow shovel.

FIG. 9 is a top view of the shovel of FIG. 8.

FIG. 10 is a left side view of the shovel of FIG. 8.

FIG. 11 is a frontal view of the shovel of FIG. 8.

DETAILED DESCRIPTION OF THE DRAWINGS

Figure 5:
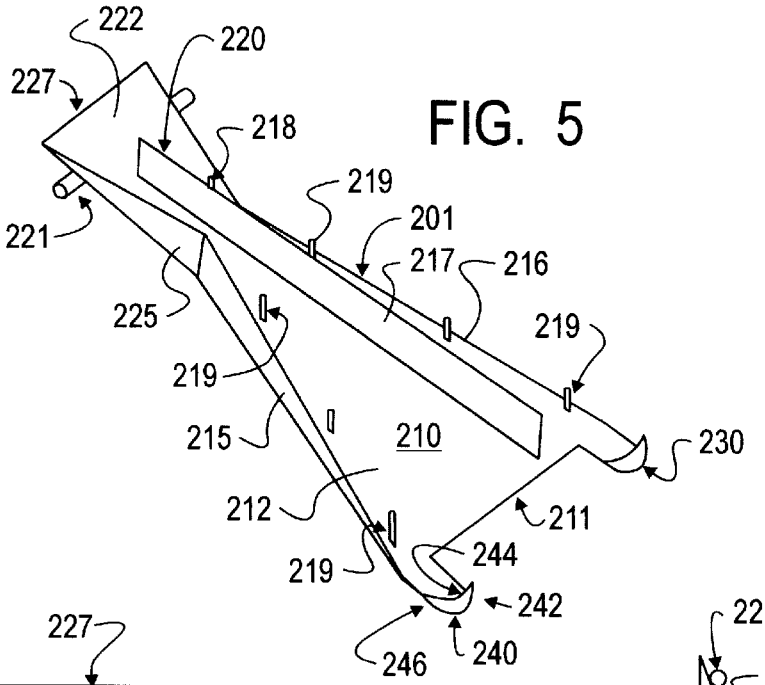
FIG. 5 is a perspective view of a triangular blade push shovel embodying features of the present invention for an improved manually pushed snow shovel.

Referring to the drawings in detail wherein like elements are indicated by like numerals, there is shown a manually pushed snow shovel 101 having the features of the preferred embodiment of the present invention comprised generally of: a blade 110; a handle means 120; a first ski runner (also known as a left ski runner) 130; and a second ski runner (also known as a right ski runner) 140. See FIGS. 1, 2, and 3. All structural components are preferably made from a strong and slippery plastic. Handle means 120 may be made stronger using wood or a light-weight metal separately or inserted within the plastic molding.

Blade 110 is comprised of a sturdy relatively flat rectangular piece having a front face 112, a rear face 113, a leading edge 111, a rear edge 114, a right side edge 115, and a left side edge 116. See FIG. 1. Rear face 113 is not shown in FIG. 1. Front face 112 is parallel to and exactly opposite rear face 113. Rear edge 114 is parallel to and opposite leading edge 111, with right side edge 115 and left side edge 116 therebetween. Blade 110 is described as suitably flat for ease of snow accumulation because it is envisioned that blade 110 can come in various designs. Blade 110 designs include angular, gently curved concave up relative to front face 112 or contain ridges. Blade 110 is designed to accumulate or push snow and therefore blade 110 may be bucket shaped or any other design which meets this purpose.

Handle means 120 is comprised of a cylindrically shaped shaft 122; and a cylindrically shaped grip cross piece 121. One end of shaft 122 is permanently fastened to rear face 113 of blade 110 and extends outwards from and perpendicular to rear edge 114 of blade 110. Grip cross piece 121 is permanently attached to the end of shaft 122 opposite the end attached to blade 110 at the center of grip cross piece 121, perpendicular to the length of shaft 122. Shaft 122 extends upwardly to grip cross piece 121 at about waist height of an average size person pushing manually pushed snow shovel 101 with the blade at an approximately thirty degree angle with the ground surface 60. Handle means 120 may be designed in any fashion to allow operation and movement of blade 110. The simplest version of handle means 120 would be like a wooden broom handle.

Left ski runner 130 resembles the front portion of a conventional downhill ski in that left ski runner 130 is a relatively thin piece with a narrow face which gently curves up to a tip on one end. Left ski runner 130 is comprised of left flat portion 131; left curved portion 132; left tip 133; left bottom surface 134; left top surface 135; and left normal ground contact point 136. See FIGS. 2, 3, 3A. Left curved portion 132 is a continuation of left flat portion 131. Left curved portion 132 narrows to left tip 133. See FIG. 2. Left top surface 135 of left flat portion 131 is permanently attached to rear face 113 on the left side of blade 110 relative to a person pushing manually pushed snow shovel 101 in direction 66. See FIG. 4. This results in left curved portion 132 extending outward from and perpendicular to leading edge 111 when viewed from the top. See FIG. 2. It should also be noted that left ski runner 130 may also be attached to blade 110 via left bottom surface 134 to front face 112 of blade 110. Left curved portion 132 is concave up relative to front face 112 of blade 110. Left bottom surface 134 and left top surface 135 of left flat portion 131 are parallel to rear face 113. Left normal ground contact point 136 is that area on left bottom surface 134 from which imaginary tangent line 137 drawn from forms an approximately thirty degree angle with left side edge 116 at leading edge 111. See FIG. 3A. This angle is described as approximately thirty degrees because it is expected that the angle will be actually be between twenty and forty depending on the comfort level of the user. Where blade 110 is slightly curved concave up, left normal ground contact point 136 is that area on left bottom surface 134 from which imaginary tangent line 137 drawn from forms an approximately thirty degree angle with a tangent to left side edge 116 at leading edge 111. Viewed from the left side (see FIG. 3A), leading edge 111 is at or behind (relative to user forward pushing motion direction 66, see FIG. 4) left normal ground contact point 136 of left bottom surface 134.

Right ski runner 140 is mechanically identical to left ski runner 130 and is comprised of right flat portion 141; right curved portion 142; right tip 143; right bottom surface 144; right top surface 145; and right normal ground contact point 146. Right curved portion 142 is a continuation of right flat portion 141. Right curved portion 142 narrows to right tip 143. See FIG. 2. Right top surface 145 of right flat portion 141 is permanently attached to rear face a 113 on the right side of blade 110 relative to a person pushing manually pushed snow shovel 101. Like left ski runner 130, right ski runner 140 may also be attached to blade 110 at front face 112. This results in right curved portion 142 extending outward from and perpendicular to leading edge 111 when viewed from the top. See FIG. 2. Right curved portion 142 is concave up relative to front face 112 of blade 110. Right bottom surface 144 and right top surface 145 of right flat portion 141 are parallel to rear face 113. Right normal ground contact point 146 is that point on right bottom surface 144 from which imaginary tangent line 147 drawn from forms an approximately thirty degree angle with right side edge 115 at leading edge 111. See FIG. 3B. Where blade 110 is slightly curved concave up, right normal ground contact point 146 is that point on right bottom surface 144 from which imaginary tangent line 147 drawn from forms an approximately thirty degree angle with a tangent to right side edge 115 at leading edge 111. Viewed from the right side (see FIG. 3B), leading edge 111 is at or behind (relative to user forward pushing motion) right normal ground contact point 146 of right bottom surface 144.

Left bottom surface 134 and right bottom surface 144 can be coated with a no stick surface 138 such as paraffin or a slippery plastic (not shown).

The use of left ski runner 130 and right ski runner 140 as skids for manually pushed snow shovel 101 and the relative location of leading edge 111 of blade 110 to left normal ground contact point 136 and right normal ground contact point 146 are the major innovations of this invention. The relative location of leading edge 111 results in a shift of the pivoting point and location of downward vertical force of manually pushed snow shovel 101 to forward of blade 110 leading edge 111 relative to user forward motion. Since normal user force on handle means 120 is forward and upwards, the manually pushed snow shovel 101 will pivot in such a way as to raise leading edge 111 away from ground surface 60 upon the encountering of increased friction with ground surface 60. See FIG. 4. The initial angle with the ground can be described as an approximately thirty degrees because it is not absolutely critical that the pivot point shift to forward of the leading edge when the shovel blade is at thirty degrees with the ground and the user applies the natural forward and upward pushing force upon a friction increase. What is critical is that the user need only pivot the handle and hence the blade only a small amount to have the leading edge behind the pivot point and hence lift away from the ground surface upon the friction increase. It is also important to note that although FIG. 1 shows a blade 110 as flat, the blade may be any shape designed to accumulate or push snow without encountering excessive sideways forces. In these designs of variable shaped blades there is always a leading edge; the approximately thirty degree angle is measured between an imaginary line from handle means 120 where gripped by the user to leading edge 111 or blade 110 and the ground surface 60.

Although only left ski runner 130 and right ski runner 140 are described for the embodiment shown in FIGS. 1 to 4, it is envisioned that additional ski runners of similar design could be similarly installed on manually pushed snow shovel 101 for added stability.

In operation, the user of manually pushed snow shovel 101 grasps grip cross piece 121 with two hands, one hand on either side of the point of attachment to shaft 122. Blade 110 is held at an approximate thirty degree angle with ground surface 60 with left normal ground contact point 136 and right normal ground contact point 146 of left bottom surface 134 and right bottom surface 144, respectively placed in contact with the ground surface 60. See FIGS. 3A, 3B, and 4. The user pushes on grip cross piece 121 and thereby handle means 120 and moves blade 110 across the ground surface 60 in direction 66 while maintaining a relatively constant thirty degree angle with the ground surface 60. See FIG. 4. Snow 61 is scraped from ground surface 60 and moves in direction 62 onto blade 110. Snow accumulations 63 gather on front face 112 of blade 110.

If the user of manually pushed snow shovel 101 encounters surface irregularities or heavy wet snow, the user's natural force on handle means 120 and hence blade 110 results in upwards and forward pivoting in direction 51 to increase blade 110 to ground surface 60 angle. See FIG. 4. The entire manually pushed snow shovel 101 pivots on left curved surface 132 and right curved surface 142 of left ski runner 130 and right ski runner 140, respectively. This pivoting is forward of left normal ground contact point 136 and right normal ground contact point 146. The upwards pivoting or rotation of blade 110 raises leading edge 111 from ground surface 60 and hence reduces the blade stalling friction. The user's natural upward and forward force on handle means 120 hence works to alleviate stalling friction.

If the user encounters an object on ground surface 60 such as a rock 65, the user may tilt handle means 120 in downwards direction 52 to decrease blade 110 to ground surface 60 angle. See FIG. 4. Manually pushed snow shovel 101 pivots on left curved surface 132 and right curved surface 142 of left ski runner 130 and right ski runner 140, respectively. The downwards rotation of blade 110 lowers leading edge 111 closer to ground surface 60. The lower position of leading edge 111 and lesser blade 111 to ground surface 60 angle facilitates the scraping of the rock 65 onto blade 110. The horizontal force vector pushing the blade forward increases by the lower position. Snow accumulations 63 tend to apply a force on blade 110 also in downwards direction 52 to further facilitate the scraping of the rock 65 onto blade 110.

When blade 110 becomes full of snow accumulations 63, as noted by the user visually and as sensed by increased resistance against pushing handle means 120 forward, the user pushes handle means 120 and hence manually pushed snow shovel 101 to the desired location for depositing the snow accumulations 63, and rocks 65. The term 'full' describing snow accumulations 63 is a relative term depending on the physical characteristics of the user. The user tilts handle means 120 in upwards direction 51 to increase blade 110 to ground surface 60 angle. As blade 110 to ground surface 60 angle approaches 90 degrees, the snow accumulations 63, and rocks 65 slide off of blade 110. Left tip 133 and right tip 143 tend to dig into ground surface 60 hence preventing backwards slippage of blade 110 during snow unloading. The process is continued with the user pushing handle means 120 and hence manually pushed snow shovel 101 to the next area of ground surface 60 requiring snow removal.

Figure 6:
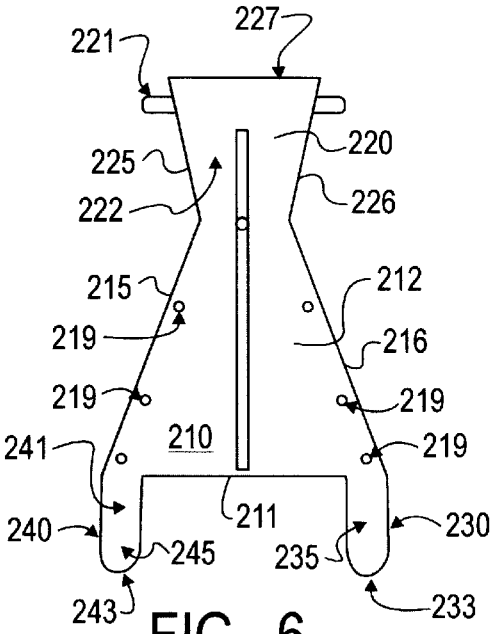
FIG. 6 is a top view of the shovel of FIG. 5.
Figure 7:
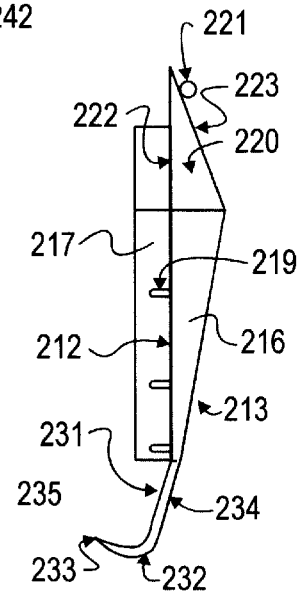
FIG. 7 is a left side view of the shovel of FIG. 5.

Another shovel having the features of the of the present invention is a triangular blade push shovel 201. See FIGS. 5 to 7. Triangular blade push shovel 201 is comprised generally of: a blade 210; a handle means, such as handle section 220; a left ski runner 230; a right ski runner 240; and a snow director 217. All structural components are preferably made from a strong and slippery plastic and integral to one another. Handle cross piece 221 may be made from any strong material such as plastic, wood or a light weight metal. A typical strong and slippery plastic is nylon or high density polyethylene.

Blade 210 is comprised of a sturdy piece having a front face 212, a rear face 213, a leading edge 211, a right side edge 215, and a left side edge 216. See FIGS. 5 to 7. When viewed from the top (FIG. 6), front face 212 is generally triangularly shaped, with the three sides being leading edge 211, right side edge 215, and left side edge 216. Right side edge 215 and left side 216 may never actually meet; handle section 220 typically joins blade 210 where right side edge 215 and left side edge 216 would join if front face 212 was a perfect triangle when viewed from the top. See FIG. 6. Blade 210 may also appear triangular when viewed from the side in that right side edge 215 and left side edge 216 overhang below rear face 213 to provide structural integrity to triangular push shovel 201. See FIG. 7.

Handle section 220 is comprised of: a handle front face 222; a handle cross piece 221; a handle rear face 223; a handle right side edge 225; a handle left side edge 226; and a handle rear edge 227. Handle front face 222 also is generally triangular shaped when viewed from the top, with the three sides of the triangle defined by handle right side edge 225, handle left side edge 226; and handle rear edge 227. See FIG. 6. Handle right side edge 225 and handle left side edge 226 never actually meet. Handle section 220 is joined to blade 210 where handle right side edge 225 would meet handle left side edge 226 if handle front face 222 was a perfect triangle when viewed from the top. See FIG. 6. The result is that blade 210 and handle section 220 give triangular blade push shovel 201 an hour-glass appearance when viewed from the top. See FIG. 6. Handle section 220 also appears triangular when viewed from the side in that handle section 220 may be relatively thick for strength where joined to blade 210 and handle section 220 narrows leading to handle rear edge 227. Handle cross piece 221 is a cylindrically shaped piece attached to handle rear face 223 and parallel to both handle rear edge 227 and leading edge 211. See FIGS. 6 and 7.

Figure 7A:
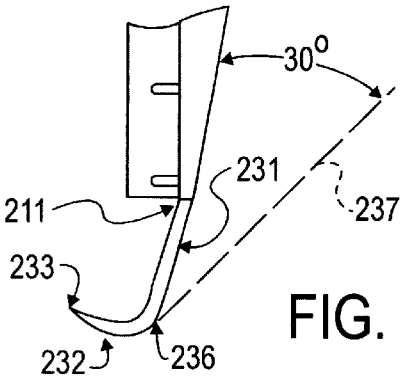
FIG. 7A is a blown up left side view of a portion of FIG. 7.

Similar to left ski runner 130 of earlier described manually pushed snow shovel 101, left ski runner 230 resembles the front portion of a conventional ski and is comprised of left flat portion 231; left curved portion 232; left tip 233; left bottom surface 234; left top surface 235; and left normal ground contact point 236. Left curved portion 232 is a continuation of left flat portion 231. Left top surface 235 of left flat portion 231 is permanently attached to rear face 213 on the left side of blade 210 relative to a person pushing triangular blade push shovel 201. This results in left curved portion 232 extending outward from and perpendicular to leading edge 211 when viewed from the top. See FIG. 6. Left bottom surface 234 and left top surface 235 of left flat portion 231 are parallel to rear face 213. See FIG. 7. Left normal ground contact point 236 is that point on left bottom surface 234 from which imaginary tangent line 237 drawn from forms an approximately thirty degree angle with left side edge 216. See FIG. 7A. Viewed from the left side (see FIG. 3A), leading edge 211 is at or behind (relative to user forward motion direction) left normal ground contact point 236 of left bottom surface 234.

Right ski runner 240 is identical to left ski runner 230 and is comprised of right flat portion 241; right curved portion 242; right tip 243; right bottom surface 244; right top surface 245; and right normal ground contact point 246. Right top surface 245 of right flat portion 241 is permanently attached to rear face 213 on the right side of blade 210 relative to a person pushing triangular blade push shovel 201. This results in left curved portion 242 extending outward from and perpendicular to leading edge 211 when viewed from the top. See FIG. 6. Right bottom surface 244 and right top surface 245 of right flat portion 241 are parallel to rear face 213. Right normal ground contact point 246 is that point on right bottom surface 244 from which imaginary tangent line (not shown) drawn from forms an approximately thirty degree angle with right side edge 215. Viewed from the right side, leading edge 211 is at or behind (relative to user forward motion) right normal ground contact point 246 of right bottom surface 244.

Snow director 217 is a straight relatively flat piece rotatably attached to blade 210 via an attachment means such as pin 218. See FIGS. 5 and 6. Pin 218 passes through one side of snow director 217 to the other side of snow director 217 to attach snow director 217 to the top and center of front face 212. Where the handle means is handle section 220 as in the shovel version shown in FIG. 5, pin 218 passes through one side of snow director 217 to the other side of snow director 217 to attach snow director 217 to the top and center of front face 212 where blade 210 joins with handle section 220. This method of attachment allows the user to swivel snow director 217 from the left side edge 216 of front face 212 to the right side edge 215 of front face 212 and back. The swiveling of snow director 217 can be used to wipe snow from front face 212 during shovel movement or to locate snow director 217 on one side of front face 212 during shovel movement to force collected snow off of the opposite side of front face 212 from where snow director 217 is positioned. Mechanical stop means 219 are located on both the right side edge 215 and left side edge 216 sides of front face 212 to maintain snow director 217 on one side or the other of front face 212. Triangular blade push shovel 201 is capable of higher efficiency since it can selectively direct snow to the side thereby allowing a driveway to be cleaned in lengthwise passes.

The triangular blade push shovel 201 embodiment of the invention is used in a very similar fashion as the manually pushed snow shovel 101 embodiment described earlier. It is additionally capable of higher work efficiency since snow director 217 and the two converging sides encourage snow to fall off to the side desired. The user grasps a side of handle cross piece 221 with each hand and with left normal ground contact point 236 and right normal ground contact point 246 on the ground surface 60, the user pushes handle section 220 and hence blade 210 while maintaining an approximate angle of thirty degrees between front face 212 and ground surface 60. The user may position snow director 217 on either side of front face 212 to direct snow off of the opposite side of front face 212 or may swivel snow director 217 about pin 218 periodically during shoveling to wipe snow from front face 212.

Another shovel having the features of the present invention is a shovel having raised sides which double as ski runners, designated a scoop shovel 301, comprised generally of: a blade 310; and a handle means 320. See FIGS. 8 to 11.

Blade 310 is comprised of: a rectangular piece with a front face 312, a rear face 313, a leading edge 311, and a rear edge 314; a raised rear edge 324; a right side combination edge runner 315, and a left side combination edge runner 316. See FIG. 8. Rear face 313 is not shown in FIG. 8. Front face 312 is parallel to and exactly opposite rear face 313. Raised rear edge 324 in combination with front face 312, right side combination edge runner 315, and left side combination edge runner 316 form a scoop open at the top and the front at leading edge 311.

Handle means 320 is comprised of a cylindrically shaped shaft 322; and a cylindrically shaped grip cross piece 321. One end of shaft 322 is permanently fastened to raised rear edge 324 of blade 310 and extends outwards from and perpendicular to rear edge 314 of blade 310 when viewed from the top. See FIG. 9. Grip cross piece 321 is permanently attached to the end of shaft 322 opposite the end attached to blade 310 at the center of grip cross piece 321, perpendicular to the length of shaft 322. Shaft 322 extends upwardly to grip cross piece 321 at about waist height of an average size person pushing scoop shovel 301 with imaginary line 338 from grip cross piece 321 to leading edge 311 at an approximately thirty degree angle with the ground surface 60. Handle means 320 may be designed in any fashion to allow operation and movement of blade 310.

Right side combination edge runner 315, and left side combination edge runner 316 provide the same function for shovel 301 as left ski runner 130 and right ski runner 140 provide for manually pushed snow shovel 101. Left side combination edge runner 316 is a relatively flat piece shown perpendicular to front face 312, however angles as much as 135 degrees to the front face are envisioned. When viewed from the side, left side combination edge runner 316 has four sides, three of which are straight and the fourth being curved. See FIG. 10. This curved side is designated left curved surface 332. Left curved surface 332 commences at the point nearest to leading edge 311 and continues concave upwards and away from leading edge 311 to form left tip 333. Left tip 333 overhangs over leading edge 311 and may also contain left tip extension 335. See FIGS. 8, 9, and 11. Left tip extension 335 provides variable surface area to come in contact with the ground surface 60 and extends from left curved surface 332 inwards along leading edge 311 and towards the center of leading edge 311. Left tip extension 335 is essentially a ski-like extension from and approximately perpendicular to leading edge 311 when viewed from the top. See FIG. 9. Left tip extension 335 is also curved concave upwards from leading edge 311 relative to front face 312.

When viewed from the side, left normal ground contact point 336 is that point on left curved surface 332 and left tip extension 335 from which imaginary tangent line 337 drawn from forms an approximately thirty degree angle with imaginary line 338 drawn from grip cross piece 321 to leading edge 311. See FIG. 10. Viewed from the left side, leading edge 311 is at or behind (relative to user forward motion direction) left normal ground contact point 336 of left curved surface 332 and left tip extension 335.

Right side combination edge runner 315 is a relatively flat piece shown perpendicular to front face 312. When viewed from the side, right side combination edge runner 315 has four sides, three of which are straight and the fourth being curved. This curved side is designated right curved surface 342. Right curved surface 342 commences at the point nearest to leading edge 311 and continues concave upwards and away from leading edge 311 to form right tip 343. Right tip 343 overhangs over leading edge 311 and may also contain right tip extension 345. See FIGS. 9, and 11. Right tip extension 345 provides additional surface area to come in contact with ground surface 60 and extends from right curved surface 342 inwards along leading edge 311 and towards the center of leading edge 311. Right tip extension 345 is essentially a ski-like extension from and approximately perpendicular to leading edge 311 when viewed from the top. See FIG. 9. Right tip extension 345 is also curved concave upwards from leading edge 311 relative to front face 312.

When viewed from the side, the right normal ground contact point (not shown) is that point on right curved surface 342 and right tip extension 345 from which imaginary tangent line 337 drawn from forms an approximately thirty degree angle with imaginary line 338 drawn from grip cross piece 321 to leading edge 311. Viewed from the right side, leading edge 311 is at or behind (relative to user forward motion direction) the right normal ground contact point of right curved surface 342 and right tip extension 345.

The scoop shovel 301 embodiment of the invention is used in a very similar manner as the manually pushed snow shovel 101 embodiment described earlier. The user grasps grip cross piece 321 with two hands, one hand on either side of the point of attachment to shaft 322. Blade 310 is held such that an imaginary line 338 drawn from grip cross piece 321 to leading edge 311 is at an approximate thirty degree angle with ground surface 60 with left normal ground contact point 336 and a right normal ground contact point placed in contact with the ground surface 60. The user pushes grip cross piece 321 and hence blade 310 while substantially maintaining the above described angle.

Other embodiments may be readily devised by those skilled in the art which will embody the principles of the invention and fall within the spirit and scope thereof.

What is claimed is:

1. A triangular blade push shovel, comprising:

a. a blade having a front face, a rear face, a leading edge, a right side edge and a left side edge; and said front face and said rear face of said blade are generally triangular shaped with said leading edge, said right side edge, and said left side edge defining said triangular shape;

b. a first ski runner having;

i. a flat portion and a curved portion, said flat portion and said curved portion each having a bottom surface and a top surface;

ii. said flat portion attached to said blade and extending out from said leading edge of said blade closer to said left side edge of said blade than to said right side edge of said blade so that said curved portion is concave up relative to said front face and said flat portion is perpendicular to said leading edge of said blade;

iii. a normal ground contact point on said bottom surface of said curved portion, said normal ground contact point being that area on said bottom surface of said curved portion in contact with a ground surface to be plowed when said left side edge and said right side edge at said leading edge are at an approximately thirty degree angle with the ground surface;

iv. said flat portion is attached to said blade so that said leading edge of said blade is behind said normal ground contact point relative to a person pushing said manually pushed snow shovel on the ground surface; and c. a second ski runner, identical to said first ski runner, with said second ski runner attached to and extending out from said leading edge of said blade closer to said right side edge of said blade symmetrical to said first ski runner;

d. a handle means attached to said blade.

2. A triangular blade push shovel as recited in claim 1, further comprising:

a. a snow director comprising:

i. a relatively flat piece rotatably attached via an attachment means to a top and center point of said front face of said blade; and ii. mechanical stop means on said front face adjacent both said right side edge and said left side edge.

3. A triangular blade push shovel as recited in claim 2, wherein said rotatable attachment means of said snow director to said front face is a pin.

4. A triangular blade push shovel as recited in claim 2, wherein:

a. said handle means is attached to said blade where said left side edge and said right side edge approach intersection;

b. said handle means is comprised of;

i. a generally triangular shaped handle front face, a generally triangular shaped handle rear face, a handle cross piece, a handle right side edge, a handle left side edge, and a handle rear edge with said handle right side edge, said handle left side edge and said handle rear edge defining said generally triangular shape of said handle front face and said handle rear face;

ii. said handle means being attached to said blade where said handle right side edge and said handle left side edge approach intersection; and iii. said handle cross piece is attached to said handle rear face parallel to said handle rear edge and said leading edge; and c. said snow director extends up to said handle front face from said rotatable attachment means on said front face.

* * * * *